US006344103B1

(12) United States Patent
Cheng et al.

(10) Patent No.: US 6,344,103 B1
(45) Date of Patent: Feb. 5, 2002

(54) SUBLIMATION PROCESS OF TRANSFERRING A DECAL TO SURFACE OF A WATCH CASE

(76) Inventors: Hsien-Chang Cheng, No. 11, Lane 19, San Jun St., Su Lin Chen, Taipei Hsien (TW); Stephen J. Petre, 7 Park Ave., White Plains, NY (US) 10603

( * ) Notice: Subject to any disclaimer, the term of this patent is extended or adjusted under 35 U.S.C. 154(b) by 0 days.

(21) Appl. No.: 09/511,899

(22) Filed: Feb. 23, 2000

(51) Int. Cl.[7] ..... B44C 1/17; B44C 1/24; B41M 5/035; G04B 37/14; A44C 5/00

(52) U.S. Cl. ..... 156/230; 156/240; 156/241; 156/247; 156/285; 156/289; 427/146; 427/147; 427/148; 428/914; 368/282; 224/173; 224/178; 29/896.411

(58) Field of Search ..... 156/230, 232, 156/233, 237, 238, 239, 240, 241, 247, 277, 287, 540, 272.2, 285; 427/146, 147, 148; 428/914; 8/467, 468, 471, 472; 430/199, 201, 202, 203; 368/282, 286; 224/164, 173, 178, 179; 29/896.411; 40/633

(56) References Cited

U.S. PATENT DOCUMENTS

| | | | | | |
|---|---|---|---|---|---|
| 4,856,857 | A | * | 8/1989 | Takeuchi et al. | 350/3.6 |
| 4,923,848 | A | * | 5/1990 | Akada et al. | 156/235 |
| 5,893,964 | A | * | 4/1999 | Claveau | 156/240 |
| 5,895,541 | A | * | 4/1999 | Kobayashi et al. | 156/240 |

FOREIGN PATENT DOCUMENTS

| | | | | | |
|---|---|---|---|---|---|
| JP | 62051408 | A | * | 3/1987 | B29C/39/10 |
| JP | 62051409 | A | * | 3/1987 | B29C/39/10 |
| JP | 05309005 | A | * | 11/1993 | A44C/5/00 |

* cited by examiner

*Primary Examiner*—Richard Crispino
*Assistant Examiner*—J. A. Lorengo
(74) *Attorney, Agent, or Firm*—Browdy and Neimark

(57) ABSTRACT

A sublimation decalcomania of the surface of a watch case includes a first step in which the surface of the watch case is provided with a coating before the watch case and a decal-bearing paper are held in a plastic bag. The plastic bag containing the coated watch case and the decal-bearing paper is exhausted of air by a vacuum device. The vacuum bag is then baked in an oven to bring about the sublimation transfer of the decal to the coated surface of the watch case.

6 Claims, 8 Drawing Sheets

SUBLIMATION PROCESS OF TRANSFERRING A DECAL TO SURFACE OF A WATCH CASE

FIELD OF THE INVENTION

The present invention relates generally to a decalcomania, and more particularly to a sublimation decalcomania of the surface of a wrist watch case.

BACKGROUND OF THE INVENTION

There are a variety of methods for printing words or designs on the surface of an object. One of the methods is known as the sublimation decalcomania comprising a specially prepared paper on which a decal is printed for transferring to the surface of an object made of glass, wood, metal, etc. The ink of the decal is transferred to the surface of the object by the heat sublimation of the ink when the object and the decal-bearing paper are baked together.

The conventional method comprises a first step involving the coating of an adhesive on the surface of an object to be processed. The decal-bearing paper is attached manually to the coated surface of the object. In light of the manual operation of the conventional method described above, the conventional method is time-consuming and inefficient at best. In addition, the quality of work done by the conventional method is often poor in view of the fact that the decal-bearing paper is not evenly and intimately joined with the surface of the object. Such a problem becomes more acute when the surface of the object is irregular and wrinkled.

As illustrated in FIG. 1, a wrist watch has a metal case A formed of a main body A1 and two watchbands A2 extending in opposite directions from the main body A1. The conventional sublimation decalcomania described above is not suitable for use in printing the surfaces of the main body A1 and the watchbands A2. In light of such a technical infeasibility, the surfaces of the main body A1 and the two watchbands A2 are electroplated. The coating of a decorative design or picture on the metal case A of the wrist watch by the electroplating process is monotonous and far from being exquisite.

A cheap wrist watch often has a plastic case which is coated with decorative designs or pictures by a web fed press. In spite of the designs or pictures being versatile, the feel of the plastic watch case is much lower in quality than that of the metal watch case.

SUMMARY OF THE INVENTION

The primary objective of the present invention is to provide a cost effective and high-quality sublimation process of transferring a decorative picture or design from a decal-bearing paper to the surface of a watch case.

The sublimation decalcomania of the present invention comprises a first step in which the surface of a watch case is provided with a foundation coat. A decal-bearing paper is then prepared such that the size of the decal-bearing paper is corresponding in size to the area of the foundation coat of the watch case surface. An airtight soft bag of a plastic material is also prepared such that the airtight soft bag is provided with an opening. Upon completion of the drying of the foundation coat, the watch case and the decal-bearing paper are put into the soft bag such that the printed surface of the paper is in contact with the foundation coat of the watch case surface. The soft bag containing the paper and the watch case is kept in an airtight space, which is subsequently exhausted of air along with the bag until the inner walls of the bag are intimately joined together, thereby forcing the printed surface of the paper to be in an intimated contact with the foundation coat. The bag is then sealed off before the bag is baked in an oven to bring about the transfer of a decorative design or picture to the surface of the foundation coat of the watch case from the decal-bearing paper. The transfer is attained by sublimation. Finally, the watch case is removed from the bag such that the remainder of the decal-bearing paper is separated from the watch case.

DETAILED DESCRIPTION OF THE INVENTION

Figure 1:
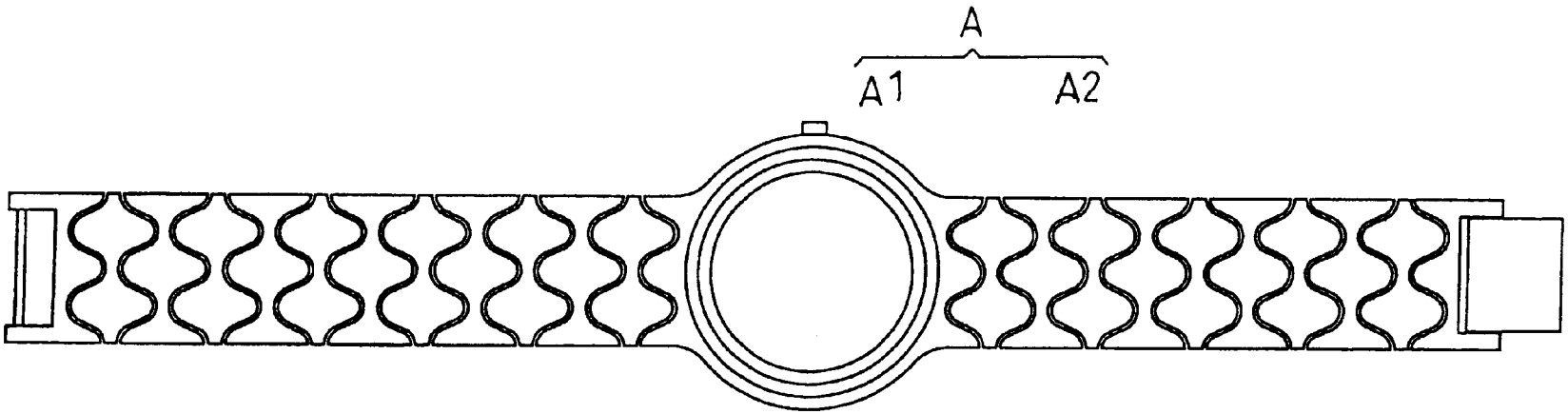
FIG. 1 shows a perspective view of a wrist watch.
Figure 2:
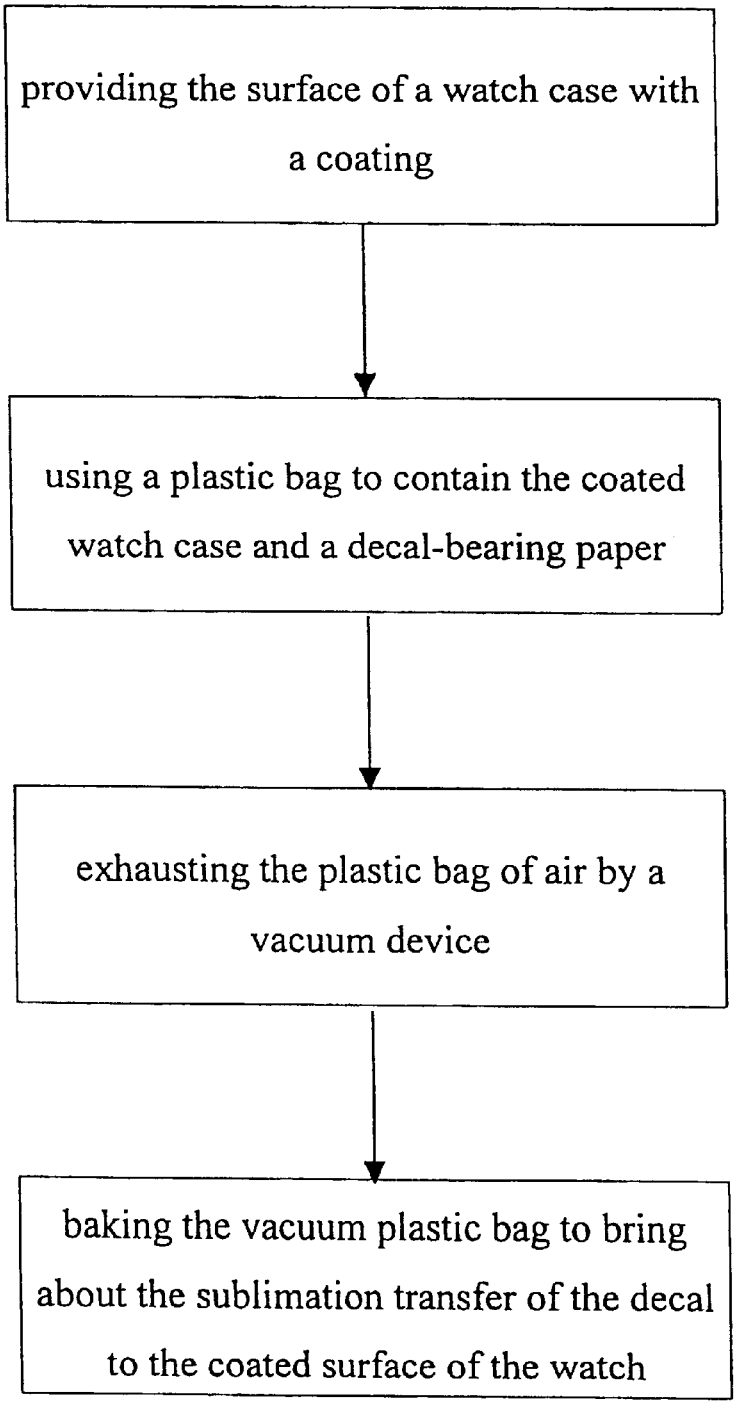
FIG. 2 shows a process flow chart of a preferred embodiment of the present invention.

As outlined in FIG. 2, a sublimation decalcomania embodied in the present invention comprises the steps which are described explicitly hereinafter.

Figure 3:
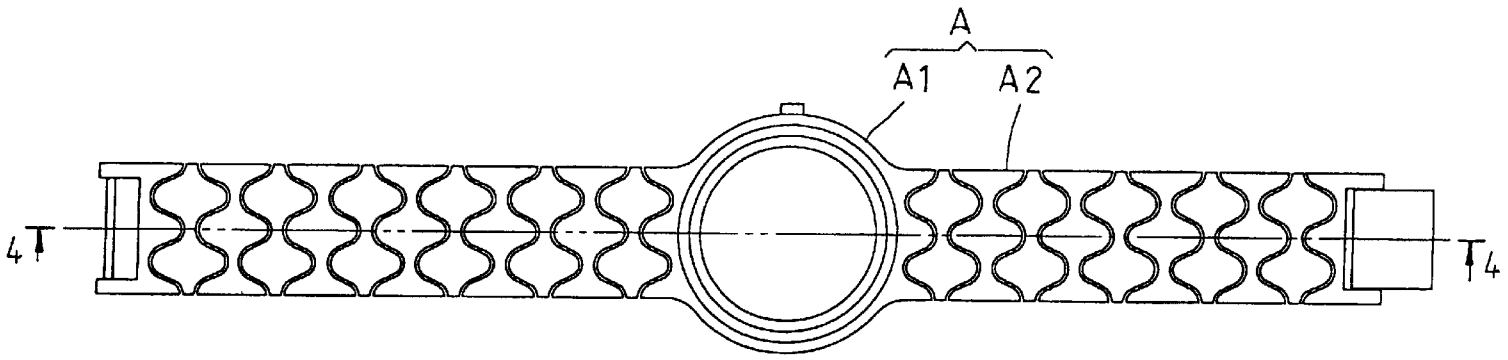
FIG. 3 shows a perspective view of wrist watch to be processed in the preferred embodiment of the present invention.
Figure 4:
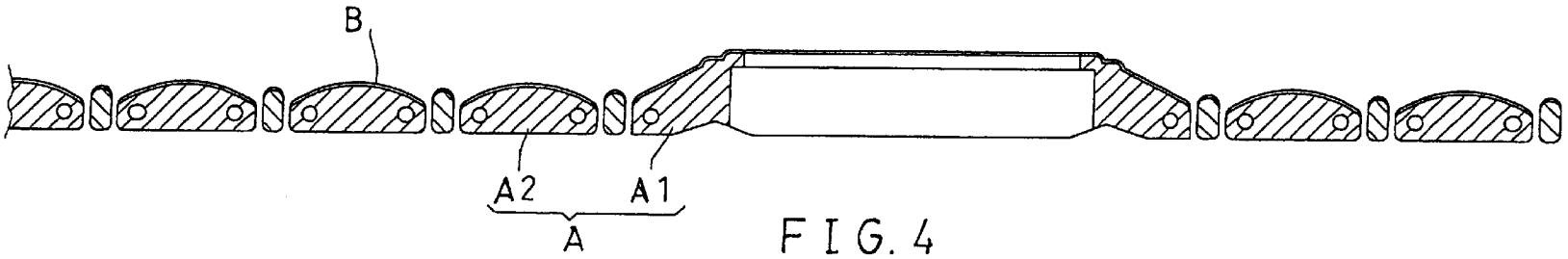
FIGS. 4, 5, 9, and 10 are schematic views of the preferred embodiment of the present invention.
Figure 5:
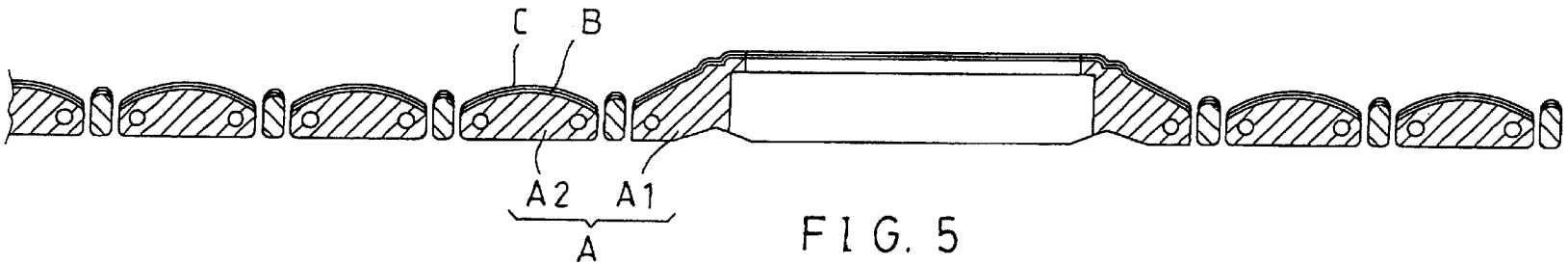

As shown in FIG. 3, a wrist watch case A has a main body A1 and a watchband A2, whose surfaces are thoroughly cleaned to be free from dust and filth. As shown in FIG. 4, the surfaces of the main body A1 and the watchband A2 are coated with a layer of resin paint B resistant to high temperature. The coating of the resin paint B is then baked at a temperature ranging between 150 and 180° C. for a period lasting between 15 and 25 minutes such that the resin paint coating is about 60 to 90% dry. Thereafter, the coating of the resin paint B is provided thereon with a coating of resin oil C, which is baked at a temperature ranging between 180 and 210° C. for a period lasting between 40 and 60 minutes, so as to make the resin oil coating glossy.

Figure 6:
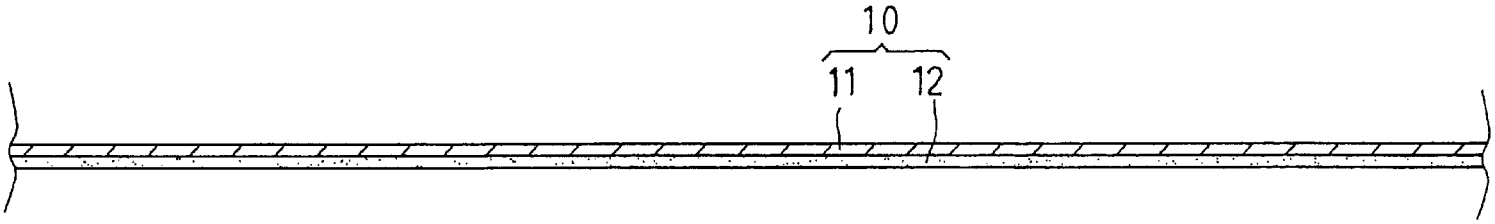
FIG. 6 shows a sectional schematic view of a decal bearing paper of the preferred embodiment of the present invention.
Figure 7:
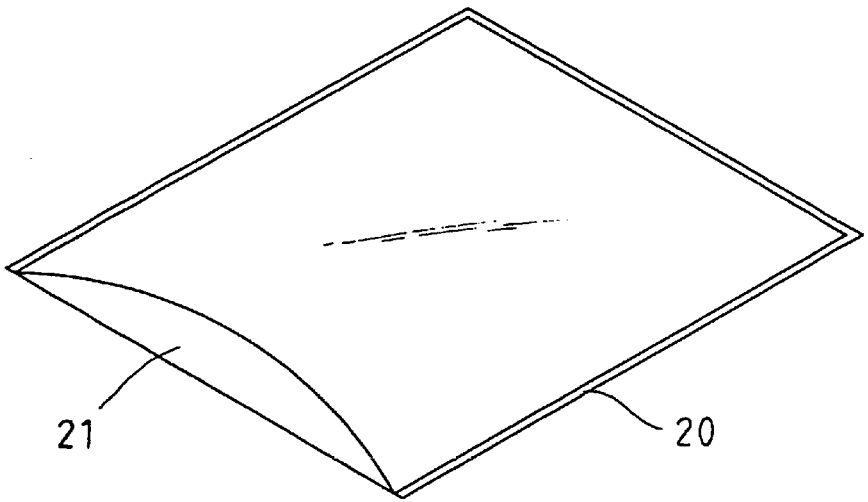
FIG. 7 shows a perspective view of bag of the preferred embodiment of the present invention.

A decal-bearing paper 10 is prepared such that the size of the paper 10 is greater than the areas of the front surface of the main body A1 and the front surface of the watchband A2 of the watch case A. In the meantime, an airtight bag 20 of a PE material is prepared, as shown in FIG. 7. The decal-bearing paper 10 is formed of a specially prepared paper 11 and a heat sublimation ink layer 12 which is coated on the surface of the specially prepared paper 11, as shown in FIG. 6. The airtight bag 20 has an opening 21.

Figure 8:
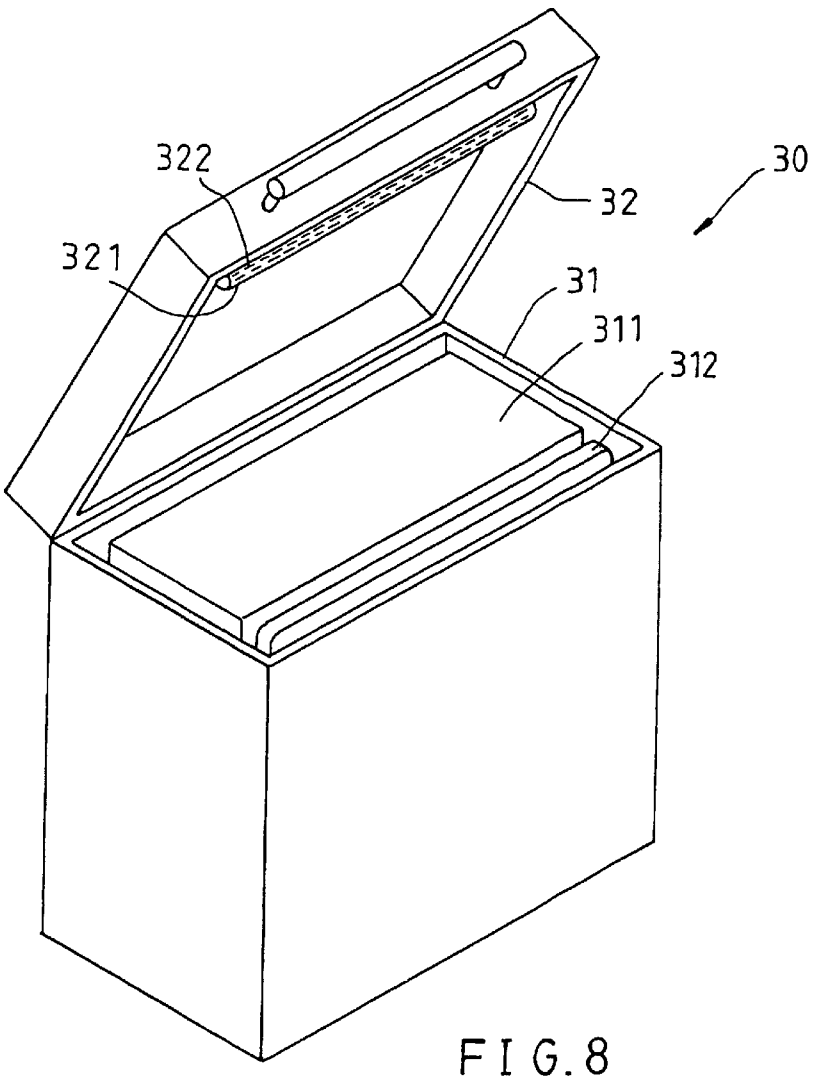
FIG. 8 shows a perspective view of a vacuum device of the preferred embodiment of the present invention.

As shown in FIG. 8, a vacuum device 30 is provided for sealing off the bag 20 in which the watch case A and the decal-bearing paper 10 are contained. The vacuum device 30 comprises a work basin 31, a cover 32, and a suction pump (not shown in the drawing). The work basis 31 is provided with a work platform 311, a sealing stand 312 located in front of the work platform 311, and a suction port (not shown in the drawing). The cover 32 is pivoted with one side wall of the work basin 31 such that the cover 32 can be joined with the work basin 31 to form therebetween an airtight space. The cover 32 is provided in the underside thereof with a thermopressure sealing head 321 which comes in contact with the sealing stand 312 at such time when the cover 32 is joined with the work basin 31. The thermopressure sealing head 321 contains two electrothermal filaments 322 parallel to each other. The suction end of the suction pump is connected by a pipe (not shown in the drawing) with the suction port of the work platform 311. The airtight space, which is formed by the work basin 31 and the cover 32, is exhausted of air by the suction pump.

Figure 9:
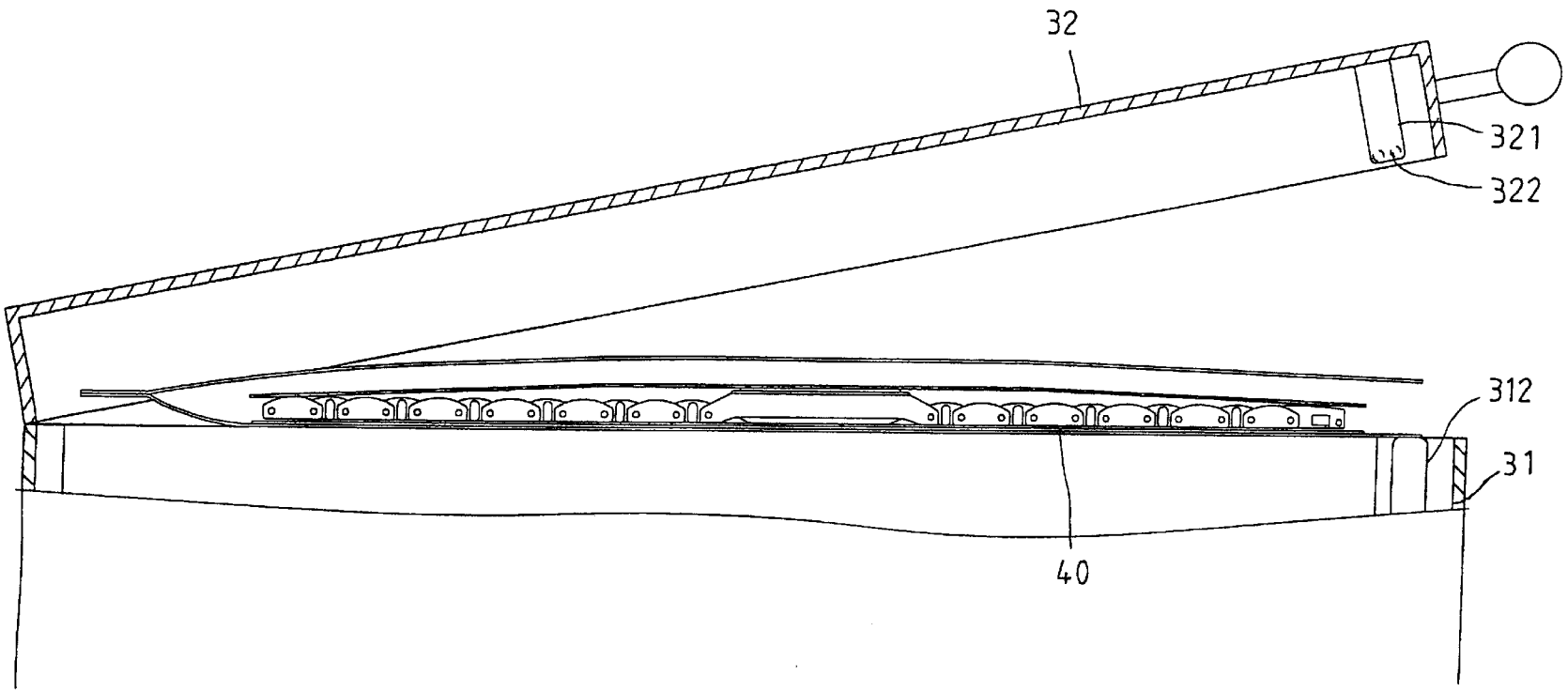

As shown in FIG. 9, the bag 20 is placed on the work platform 311 such that the opening 21 of the bag 20 is located on the sealing stand 312. The coated watch case A, the decal-bearing paper 10, and an ordinary paper sheet 40 are put into the bag 20 such that the coated watch case A is placed on the ordinary paper sheet 40, and that the front surface of the watch case faces upward, and further that the ink layer 12 of the decal-bearing paper 10 is in contact with the coated surface of the watch case A.

Figure 10:
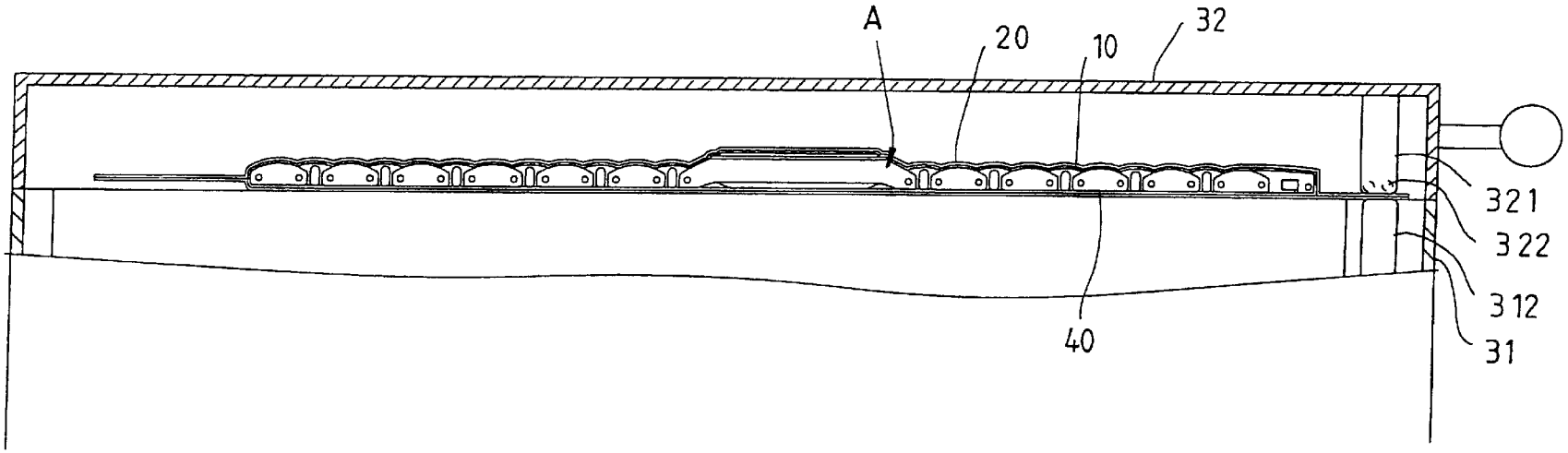

As illustrated in FIG. 10, the work basin 31 is covered by the cover 32 so as to form therebetween the airtight space. As the suction pump is started, the airtight space and the bag 20 are exhausted of air until the pressure in the bag 20 approaches OcmHg. As a result, the inner wall of the bag 20 forces the decal-bearing paper 10 to be in an intimate contact with the coated surface of the watch case A. In the meantime, the thermopressure sealing head 321 is started to cause the electrothermal filaments 322 to generate heat, which seals off the opening 21 of the bag 20. The bag 20 becomes airtight. The suction pump is then turned off. The airtight bag 20 is removed from the vacuum device 30 and is subsequently baked at a temperature ranging between 160 and 180° C. for a period lasting between 15 and 17 minutes. The link layer 11 of the decal-bearing paper 10 is thus transferred by heat sublimation to the coated surface of the watch case A.

Figure 11:
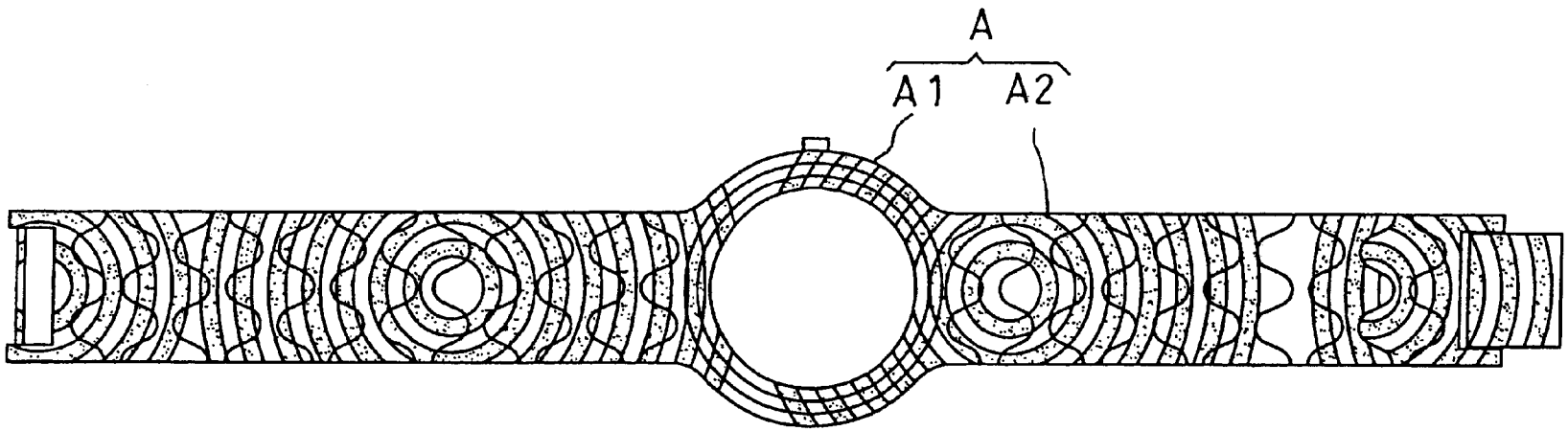
FIG. 11 shows a perspective view of a finished product of the preferred embodiment of the present invention.

Upon completion of the cooling process, the decorated watch case A is removed from the bag 20, as shown in FIG. 11.

It is therefore readily apparent that the method of the present invention is relatively cost-effective as compared with the prior art methods. In addition, the method of the present invention enhances the quality of a decal that is transferred from a specially prepared paper to the surface of an object.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A sublimation process of transferring a decal to the surface of a watch case, said process comprising the steps of:

(a) providing the surface of the watch case with a coating;

(b) preparing a decal-bearing paper corresponding in size to the coated surface of the watch case and preparing an airtight soft bag of a plastic material and having an opening;

(c) drying the coating of the surface of the watch case before the watch case and the decal-bearing paper are put into the bag such that the coating is in contact with the decal of the decal-bearing paper;

(d) arranging the bag containing the watch case and the decal-bearing paper in an airtight space of a vacuum device by which the bag is exhausted of air to cause the bag to collapse completely before the opening of the bag is sealed off such that the bag becomes airtight;

(e) baking the airtight bag of the step (d) to bring about the sublimation transfer of the decal to the watch case from the decal-bearing paper; and (f) removing the watch case from the airtight bag upon completion of the process of cooling the watch case.

2. The sublimation process as defined in claim 1, wherein the coating of the surface of the watch case is formed of a layer of resin paint resistant to high temperature, and a layer of resin oil which is coated on the resin paint layer whereby the resin paint layer is baked at a temperature ranging between 150 and 180° C. for a period lasting between 15 and 25 minutes, with the resin oil being baked at a temperature ranging between 180 and 210° C. for a period lasting between 40 and 60 minutes.

3. The sublimation process as defined in claim 1, wherein the bag is made of a PE plastic material.

4. The sublimation process as defined in claim 1, wherein the vacuum device comprises:

a work basin provided with a work platform, a sealing stand, and a suction port;

a cover pivoted with said work basin and provided with a thermopressure sealing head having two electrothermal filaments; and a suction pump connected with said suction port of said work basin;

said work basin and said cover forming therebetween an airtight space at such time when said work basin is covered by said cover for exhausting the bag of air by said suction pump and for sealing off the opening of the bag by said electrothermal filaments of said cover.

5. The sublimation process as defined in claim 1, wherein the step (c) is provided with an ordinary paper sheet which is put into the bag such that the watch case is disposed between the ordinary paper sheet and the decal-bearing paper.

6. The sublimation process as defined in claim 1, wherein the sublimation transfer of the decal in the step (e) is brought about by baking the airtight bag at a temperature ranging between 160 and 180° C. for a period lasting between 15 and 17 minutes.

* * * * *